US011598535B2

(12) United States Patent
Boucher et al.

(10) Patent No.: US 11,598,535 B2
(45) Date of Patent: Mar. 7, 2023

(54) HUMIDITY CONTROL UNIT AND METHOD

(71) Applicant: Munters Corporation, Selma, TX (US)

(72) Inventors: Michael Boucher, Lexington, VA (US); Rafael Neuwald, Lexington, VA (US)

(73) Assignee: Munters Corporation, Selma, TX (US)

( * ) Notice: Subject to any disclaimer, the term of this patent is extended or adjusted under 35 U.S.C. 154(b) by 85 days.

(21) Appl. No.: 17/013,747

(22) Filed: Sep. 7, 2020

(65) Prior Publication Data

US 2020/0400322 A1 Dec. 24, 2020

Related U.S. Application Data

(63) Continuation-in-part of application No. 15/823,700, filed on Nov. 28, 2017, now Pat. No. 10,767,875.

(51) Int. Cl.

| | |
|---|---|
| ***F24F 3/14*** | (2006.01) |
| ***F24F 13/10*** | (2006.01) |
| ***F24F 13/20*** | (2006.01) |
| ***F24F 11/80*** | (2018.01) |
| ***F24F 11/79*** | (2018.01) |

(52) U.S. Cl.

CPC ..... *F24F 3/1423* (2013.01); *F24F 11/79* (2018.01); *F24F 11/80* (2018.01); *F24F 13/10* (2013.01); *F24F 13/20* (2013.01); *F24F 2003/144* (2013.01); *F24F 2003/1464* (2013.01); *F24F 2203/1032* (2013.01)

(58) Field of Classification Search

CPC ..... F24F 3/1423; F24F 11/80; F24F 11/79; F24F 13/10; F24F 13/20; F24F 2003/144; F24F 2033/1464; F24F 2203/1032; F24F 3/14

See application file for complete search history.

(56) References Cited

U.S. PATENT DOCUMENTS

| | | | | |
|---|---|---|---|---|
| 9,739,497 | B2 | 8/2017 | Dobbs | |
| 9,920,960 | B2 | 3/2018 | Gerber et al. | |
| 2004/0000152 | A1 | 1/2004 | Fischer | |
| 2004/0089002 | A1* | 5/2004 | Rayburn | F24F 3/153 62/93 |
| 2005/0050906 | A1* | 3/2005 | Dinnage | F24F 3/1423 62/271 |
| 2011/0079024 | A1 | 4/2011 | Hakbijl et al. | |
| 2013/0248147 | A1* | 9/2013 | Wintemute | F28D 15/02 165/104.11 |
| 2019/0162431 | A1* | 5/2019 | Boucher | F24F 3/1423 |

* cited by examiner

*Primary Examiner* — Elizabeth J Martin
(74) *Attorney, Agent, or Firm* — Venable LLP

(57) ABSTRACT

In a method and apparatus for conditioning air for an enclosure, a first ambient airstream is cooled by a cooling coil of a refrigerant cooling system to reduce temperature and humidity, passed through a segment of a rotating desiccant wheel to reduce moisture content and increase temperature, and then supplied to the enclosure. The desiccant wheel is regenerated by a second ambient airstream heated with a condenser coil of the refrigerant system and then passed through a regeneration segment of the desiccant wheel. A bypass plenum allows a third ambient airstream to be selectively heated and cooled independent of the evaporator coil and desiccant wheel in the first plenum. Heated air bypassed from the second ambient airstream or an independent heater can perform the selective heating in the bypass plenum. The airstream in the bypass plenum is then supplied with the air treated in the first plenum to the enclosure.

18 Claims, 5 Drawing Sheets

HUMIDITY CONTROL UNIT AND METHOD

This application is a continuation-in-part of U.S. patent application Ser. No. 15/823,700, filed Nov. 28, 2017, the entire contents of which are incorporated by reference herein in their entirety.

The present invention relates to air conditioning and dehumidification equipment and methods, and more particularly to an air conditioning method and apparatus using desiccant wheel technology to control humidity while providing increased air flow capacity.

BACKGROUND OF THE INVENTION

Field of the Invention

It is well known that traditional air conditioning designs are not well adapted to handle both the moisture load and the temperature loads of a building space. Typically, the major source of moisture load in a building space comes from the need to supply external make-up air to the space since that air usually has a higher moisture content than required in the building. In conventional air conditioning systems, the cooling capacity of the air conditioning unit therefore is sized to accommodate the latent (humidity) and sensible (temperature) conditions at peak temperature design conditions. When adequate cooling demands exist, appropriate dehumidification capacity is achieved. However, the humidity load on an enclosed space does not vary directly with the temperature load. That is, during morning and night times, the absolute humidity outdoors is nearly the same as during higher temperature midday periods. Thus, at those times there often is no need for cooling in the space and therefore no dehumidification takes place. Accordingly, preexisting air conditioning systems are poorly designed for those conditions. Those conditions, at times, lead to uncomfortable conditions within the building and can result in the formation of mold or the generation of other microbes within the building and its duct work. On the other hand, there are periods of time, or geographic areas, where the moisture content of the air requires less dehumidification while still requiring the same or more air flow capacity.

A number of prior art devices have been suggested, using desiccant cooling systems, to solve these problems. In these devices supply air from the atmosphere is first dehumidified using a desiccant wheel or the like and the air is then cooled using a heat exchanger. The heat from this air is typically transferred to a regeneration airstream and is used to provide a portion of the desiccant regeneration power requirements. The make-up air is delivered to the space directly, as is, or alternatively is cooled either by direct evaporative means or through more traditional refrigerant-type air conditioning equipment. The desiccant wheel is regenerated with a second airstream which originates either from the enclosure being air conditioned or from the outside air. Desiccant cooling systems of this type can be designed to provide very close and independent control of humidity and temperature, but they are typically more expensive to install than traditional systems.

U.S. Pat. No. 3,401,530 to Meckler, U.S. Pat. No. 5,551,245 to Carlton, and U.S. Pat. No. 5,761,923 to Maeda disclose other hybrid devices wherein air is first cooled via a refrigerant system and dried with a desiccant. However, in all of these disclosures high regeneration temperatures are required to adequately regenerate the desiccant. In order to achieve these high temperatures, dual refrigerant circuits are needed to increase or pump up the regeneration temperature to above 140° F. In the case of the Meckler patent, waste heat from an engine is used rather than condenser heat.

Better solutions have been suggested in U.S. Pat. Nos. 6,557,365; 6,711,907 and 7,047,751, which utilize only ambient air for supply air to the enclosure and only ambient air to regenerate the desiccant. Such systems can take outside air of humid conditions, such as are typical in the South and Southeastern portions of the United States and in Asian countries and render it to a space neutral condition. Those systems have significant advantages over alternative techniques for producing air at indoor air comfort zone conditions from outside air. The most significant advantage is low energy consumption. That is, the energy required to treat the air with a desiccant assist is less than that used in previously disclosed cooling technologies.

However, such systems have air flow capacity limitations based on the size of the desiccant wheels used. Thus, in some circumstances where additional air flow capacity is required multiple units may be needed to meet capacity requirements. In climate conditions where the air is dry, such units, depending on the surrounding climate, may provide warmer and drier air than needed. The present invention allows, in such conditions, the supply of larger volumes of conditioned air at the desired temperature and humidity.

OBJECTS OF THE INVENTION

It is an object of the present invention to treat outside supply air and condition it to required needs in greater air flow capacity without the need for additional or larger desiccant wheels and therefore, in an efficient and economic manner.

Yet another object of the present invention is to provide a higher air flow capacity desiccant based dehumidification and air conditioning system which is relatively inexpensive to manufacture and to operate.

A further object of the present invention is to provide an air conditioning system which enables the operator to vary the proportioning of desiccant treated supply air with additional volume of cooled outside air that does not require further drying.

In accordance with an aspect of the invention an air conditioning and dehumidification system and method utilizes multiple air plenums in or with a housing that has first and second plenums separated by an intermediate wall. The first plenum is used to supply and treat an ambient airstream and then supply that treated air to an enclosure or other area to be cooled or treated. The system also includes a liquid vapor refrigeration circuit which contains an evaporator located in the first plenum to cool and dehumidify ambient air entering the first plenum and a condenser coil in the second plenum.

A supply fan is associated with the first plenum to draw ambient air into the plenum and supply the treated air from the plenum to the enclosure, area or space. A condenser fan is associated with the second plenum to draw another ambient airstream into the second plenum which then passes through the condenser and is heated.

A desiccant dehumidification system is included in the system which utilizes a rotatably mounted desiccant wheel mounted to extend transversely to and through the intermediate wall so that a segment of the wheel is present in the first, process air, plenum and another segment is present in the second plenum, downstream of the condenser to receive air heated in the condenser as regeneration air to regenerate the desiccant wheel as it rotates during operation and after which the regeneration air is exhausted to the atmosphere.

A third ambient air plenum is also provided as an ambient air by-pass through which ambient air is selectively supplied to the enclosure or space as capacity needs are required without treatment in the first plenum by the desiccant wheel. The third plenum contains a device for cooling the ambient air drawn into the third plenum by a fan or the like before supplying that cooled third ambient airstream to the enclosure. The cooling device may be a cooler coil from a water chiller system or an evaporator coil from a DX refrigeration system that is independent from the DX system used with the first and second plenums.

In another aspect of the invention conditioned air is supplied to an enclosure or space by cooling a first ambient supply airstream with the evaporator cooling coil of a DX refrigeration system and then passing the thus cooled and dehumidified first airstream through the process segment of a rotating desiccant wheel to further reduce moisture content in the first ambient airstream. Thereafter this treated first ambient airstream is supplied to the enclosure.

The desiccant wheel is regenerated by a second ambient airstream supplied to the second plenum which first passes through the DX condenser coil in the second plenum where its temperature is raised before passing through the desiccant wheel segment in the second plenum to regenerate the wheel. After passing through the wheel the second ambient airstream is exhausted to the atmosphere.

In addition, a third ambient airstream is selectively supplied to a third plenum preferably by a fan that is preferably independent from those fans associated with the first and second plenums. This third airstream is selectively cooled by a DX system that is independent from the cooling system used in the first and second plenums, before being supplied to the enclosure without treatment by the desiccant wheel. Alternatively, instead of having a fan in the third airstream, a damper may be placed between the third ambient airstream and the first airstream, downstream of the desiccant wheel, with a fan located in the first airstream also downstream of the desiccant wheel so that the fan or fans in the first airstream pull the total volume of air from the first and third plenums through the system.

In this way by varying the supply volume and/or temperature of cool ambient air from the third plenum, the user can increase the volume of ambient air supplied to the enclosure to better and more efficiently control the temperature and humidity of the air delivered to the enclosure when ambient temperature and humidity conditions are such that dehumidification of all the ambient air at the higher air volumes required by the operator is not necessary.

BRIEF DESCRIPTION OF DRAWINGS

The above, and other objects, features and advantages of the present invention will be apparent in the following detailed description of illustrative embodiments thereof, which is to be read in connection with accompanying drawings, wherein.

DETAILED DESCRIPTION

Figure 1:
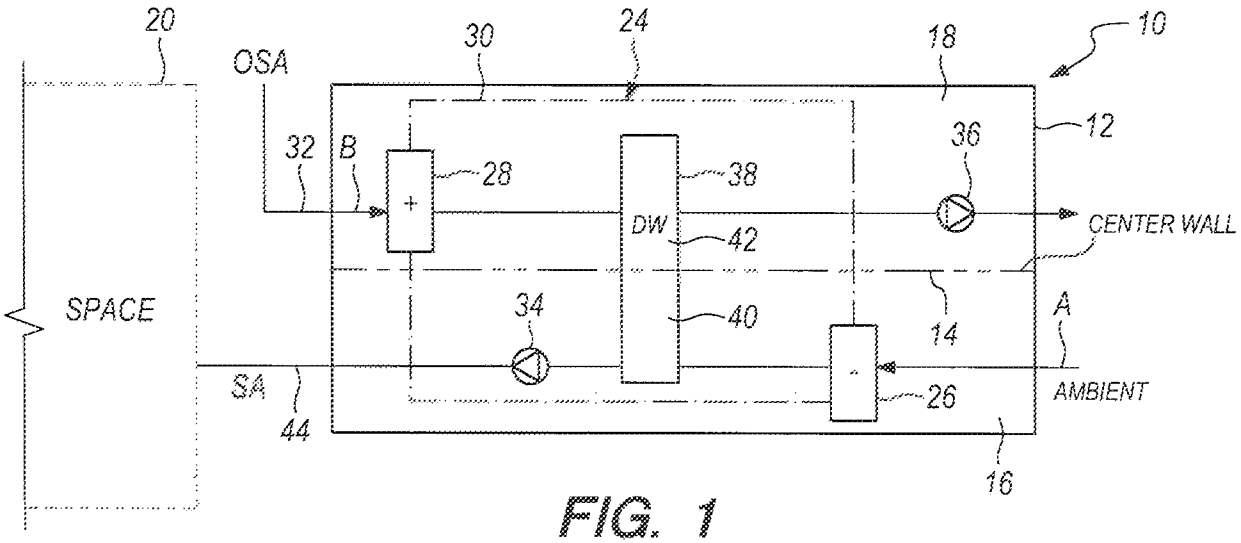
FIG. 1 PRIOR ART
FIG. 1 is a schematic top plan view of a prior art air conditioning and humidity control unit.
Figure 2:
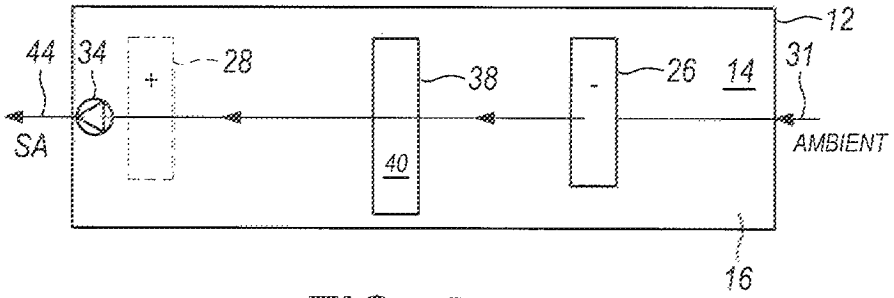
FIG. 2 PRIOR ART
FIG. 2 is a schematic side view of the prior art unit shown in FIG. 1.

Referring now to the drawings in detail, and initially to FIGS. 1 and 2, a prior art air conditioning unit 10 is illustrated of the type generally disclosed in U.S. Pat. Nos. 6,557,365, 6,711,907 and 7,047,751. The unit 10 includes a housing 12 having a separator wall 14, generally centrally located and dividing the housing into separate air plenums, namely a first plenum 16 and a second plenum 18. The unit is intended to use essentially only outside ambient air to supply conditioned dehumidified air at appropriate or desired temperature and humidity conditions to an enclosure or space 20.

The prior art air conditioning unit of FIG. 1 also includes an associated direct liquid vapor compressing expansion refrigeration system (DX) 24. The DX system 24 includes an evaporator or cooling coil 26 and a condenser coil 28, as well as one or more compressors and expansion valves (not shown) connected by liquid vapor piping 30 shown in dashed and dotted lines If plural compressors are provided, they can be activated sequentially so as to provide incremental stages of refrigeration.

As illustrated in FIGS. 1 and 2 the evaporator coil 26 is located in the first plenum 16 adjacent an ambient air inlet 31 in housing 12. The condenser coil 28 is located in plenum 18 adjacent another ambient air inlet 32 in housing 12. Fans 34 and 36 are provided in or connected to plenums 16 and 18 to draw ambient air into the respective plenums.

The housing 12 also contains a conventional rotatable desiccant wheel 38 which is rotatably mounted in housing 12 transverse to wall 14 and extending partly through the wall so that a segment (about half) of the wheel is exposed to the ambient airstreams in plenums 16, 18, during rotation of the wheel when the unit is in operation. These segments are designated 40 in the first plenum 16 (also called the process segment for the process air) and 42 in the second plenum 18 (also called the regeneration segment for the regeneration airstream).

In operation the unit of the prior art continuously supplies conditioned outside air to the enclosure. Waste air from the enclosure is exhausted in any convenient manner by fans or the like (not shown) as is known in the art. The first ambient or process airstream A is drawn by fan 34 into plenum 16 where it is cooled and dehumidified by the evaporator coil 26. The airstream A is then further dehumidified by desiccant wheel 38 in segment 40. Appropriate controls are used for the DX system 24 and to vary the speed of rotation of the wheel 38 so that the air leaving plenum 16, through an opening 44 in housing 12, has the desired temperature and humidity conditions for the space 20.

In this system ambient or outside air is also used to regenerate the desiccant wheel. That outside air, drawn in by fan 36, passes through condenser coil 28 to increase the temperature of the second ambient airstream B. This heated airstream is then passed through the regenerating section 42 of desiccant wheel 38 to remove moisture from the wheel. The second or regeneration airstream is then exhausted to the atmosphere. This prior art system may also have means to provide some or all of the air from the enclosure to the ambient airstream A for treatment in plenum 16.

Air conditioning units of the prior art as thus described have been very efficient and successful in use. However, under certain climate conditions or for certain facilities the user requires greater air flow volumes than can be treated by one unit to condition the space involved while requiring less dehumidification of the air to achieve the desired humidity condition for the volume of air to be supplied to the enclosure or space. To satisfy that need it is typically required to use two or more such units which increases the expense for the user or produces more dehumidification than is required for the space involved.

However, it has been found that climate conditions in certain areas may be such that adequate dehumidification for the air supply to the enclosure can be achieved with a single unit and dehumidification wheel.

These issues have been resolved by the present invention which utilizes a separate third ambient airstream with no, or some, additional cooling and dehumidification, depending on the requirements of the user and the ambient conditions, that does not need additional dehumidification on the desiccant wheel.

Figure 3:
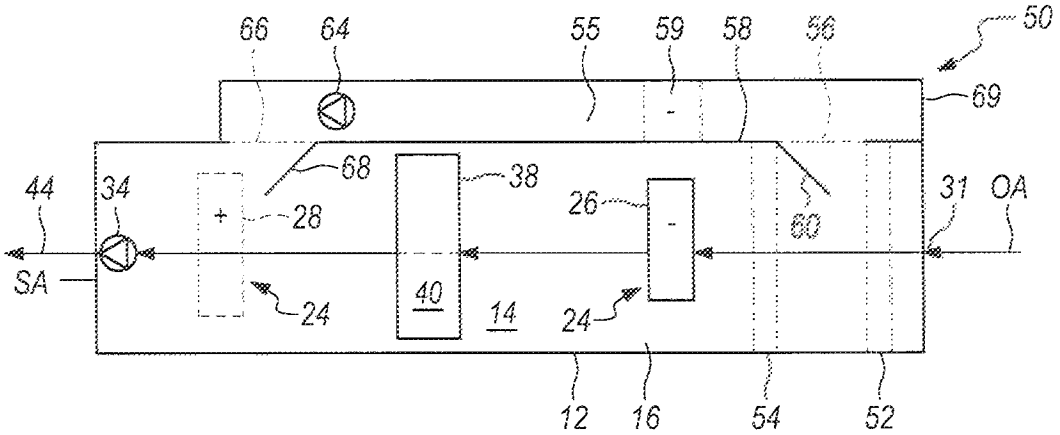
FIG. 3 is a schematic side view of an air conditioning and humidity control unit according to the present invention.
Figure 4:
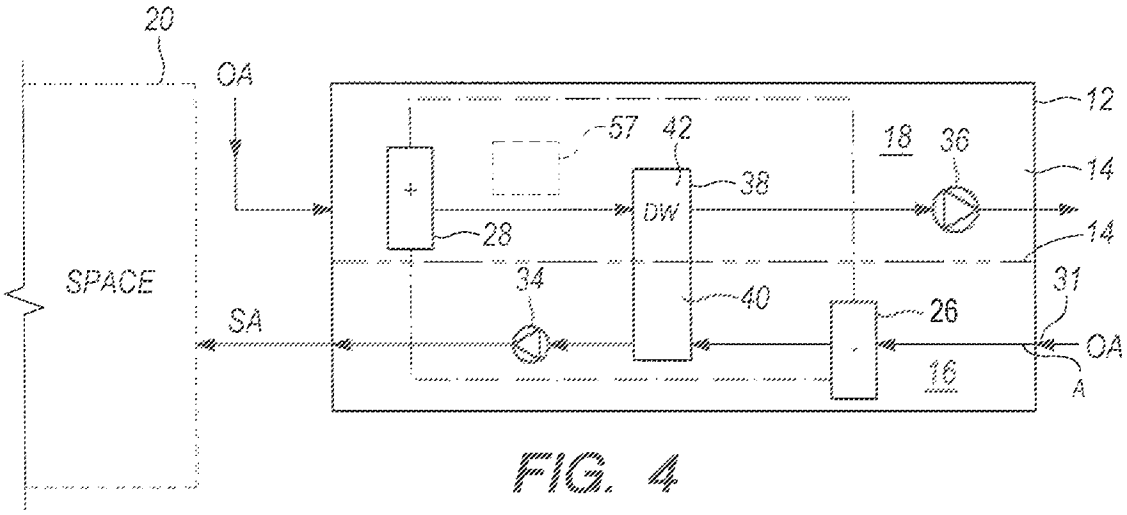
FIG. 4 is a top plan view of the view of the embodiment of FIG. 3 with the by-pass plenum removed for clarity.

FIGS. 3 and 4 illustrate additional embodiments of an air conditioning and dehumidification unit 50 according to the present invention. In these figures the reference numbers used in FIGS. 1 and 2 are used for the corresponding components in this embodiment.

As in the prior art, unit 50 shown in FIG. 3 has first and second air plenums 16, 18 (not seen in FIG. 3) separated by a central wall 14. Ambient air constituting the process or supply airstream OA enters housing 12 at opening 31 under the influence of a fan 34. As illustrated in FIG. 3, the airstream may be first passed through a conventional air filter 52 and then through a water chiller 54 for preliminary cooling, if necessary or desired. Alternatively, there can also be a condensing coil of a separate DX system (not shown) down stream of opening 31 and before cooling coil 26 that will give off heat to the ambient air when conditions warrant that. In another alternative embodiment there can also be a separate DX cooling coil for preliminary cooling where the condensing coil in the system gives off heat to the ambient air when conditions warrant that.

From the chiller 54 the air is treated in the DX system evaporator coil 26 where it is dried and cooled and then passed through the process air segment 40 of desiccant wheel 38 in which it is further dried. From there it is supplied to the enclosure or space 20.

The second ambient airstream is drawn into plenum 18 on the opposite side of wall 14 from plenum 16 by fan 36, (FIG. 4). It is first passed through condenser coil 28 of the DX system to be heated and, as before, then passed through the regeneration section 42 of desiccant wheel 38 to regenerate the wheel; it is then exhausted to the atmosphere.

A third air plenum 55 (FIG. 3) is provided to supply a volume of cooled ambient air to the enclosure without passage through the desiccant wheel. This plenum is provided in any convenient manner and is illustrated as a duct that is mounted on or formed as part of the housing 12, above the top 58 of plenums 16 and 18. However it will be understood that it can be associated with the system in any convenient manner.

As also seen in FIG. 3, the third air plenum 55 can communicate with the first air plenum 16 through passage 56 in the top wall 58 of housing 12. The passage 56 is opened or closed by a damper 60 of any convenient or known construction so that when the damper is opened, or partially opened, some of the ambient air drawn into plenum 16 is also drawn into plenum 55 by a third plenum fan 64. The damper 60 is controlled by any known control system to open or close the damper or hold it in partly opened positions to control the amount of air entering the third plenum.

The third airstream in plenum 55 may selectively be cooled as required by the evaporator coil 59 of a DX refrigeration system that is independent of the DX system 24 used in the first and second plenums or by a separate water-chilled cooler.

The cooled third airstream by-passes the desiccant wheel in housing 12 and is returned to the first or process airstream in plenum 16 downstream of the desiccant wheel through another passageway or opening 66 under the control of a damper 68. The damper 68 is opened and closed by a control system as would be understood by those skilled in the art.

In another alternative embodiment the fan 64 can be eliminated and the fan 34 used alone to draw outside air into plenum 16 and thence a portion of it into plenum 55 through passage 56 before passing through the evaporator 26. In both embodiments the first and third airstreams mix and are supplied together to the enclosure. Where conditions warrant, sufficient air is dried in the first plenum to reduce the humidity and temperature of a part of the required volume of supply air, while a portion of ambient air is simply cooled (and partly dried when an evaporator coil 59 is used), so that when the two airstreams mix the result has the desired overall temperature and humidity conditions needed in the enclosure. In this embodiment instead of using the damper 60 to control air flow the fan 64 could be provided as a modulating fan that can vary the outside air flow through plenum 55 from passage 56 or, as described below, through an ambient air inlet in end wall 69.

It is to be understood, that in lieu of the passage 56 and damper 60 described above, the third plenum can be constructed so that an ambient air inlet is provided in its end wall 69 which can be opened and closed by a damper similar to damper 60 described above.

Figure 3A:
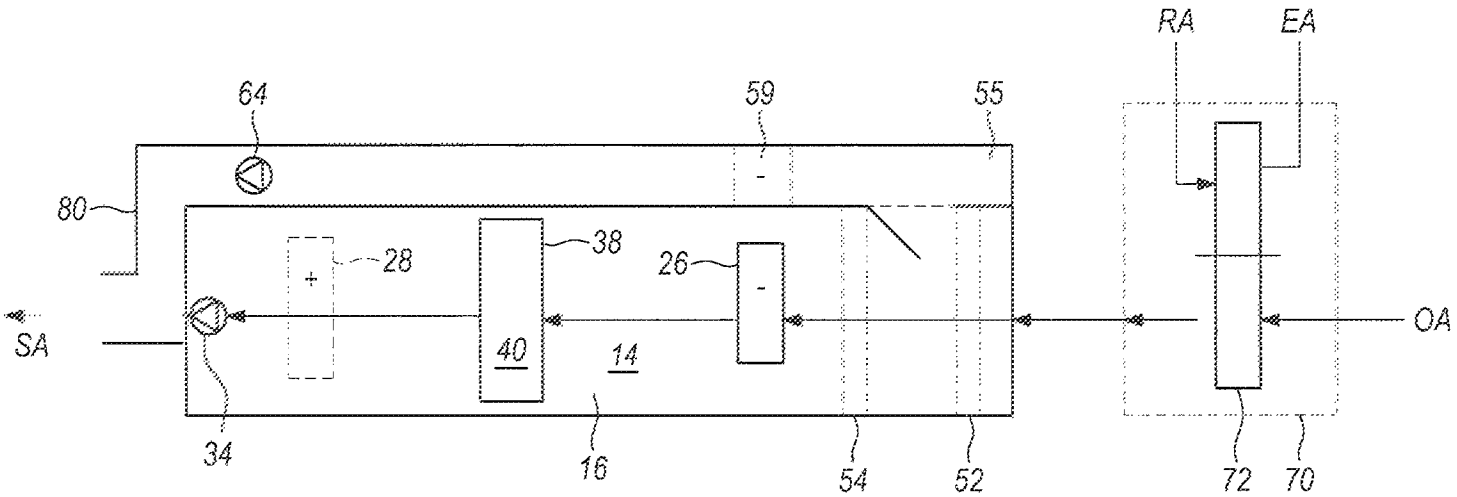
FIG. 3A is a schematic side view of another embodiment of an air conditioning and humidity control unit according to the present invention including an optional pre-treatment device.

FIG. 3*a* illustrates alternative embodiments of the invention in which a pretreatment unit 70 is provided to cool the ambient airstream before it enters the first plenum. This pre-treatment unit may be a heat exchanger of any known type including for example an enthalpy wheel 72.

As illustrated, the ambient airstream enters the enthalpy wheel 72 and is cooled before entering the evaporator 26. The enthalpy wheel is regenerated by return air removed from the enclosure by a separate ducting system and then exhausted to the atmosphere.

FIG. 3A also illustrates that rather than mixing the bypass air in the first plenum, the third plenum can be extended at its discharge end 80 to supply the bypass air directly to the enclosure.

Figure 4A:
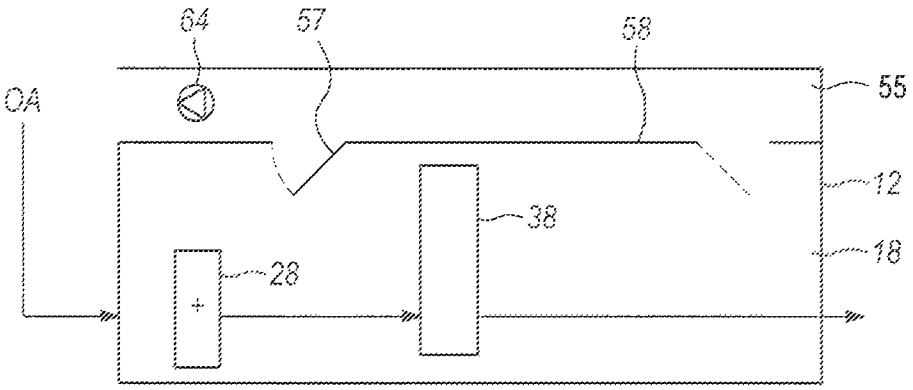
FIG. 4A is schematic side view of the plenum 18 shown in FIG. 4, including the bypass plenum.
Figure 4B:
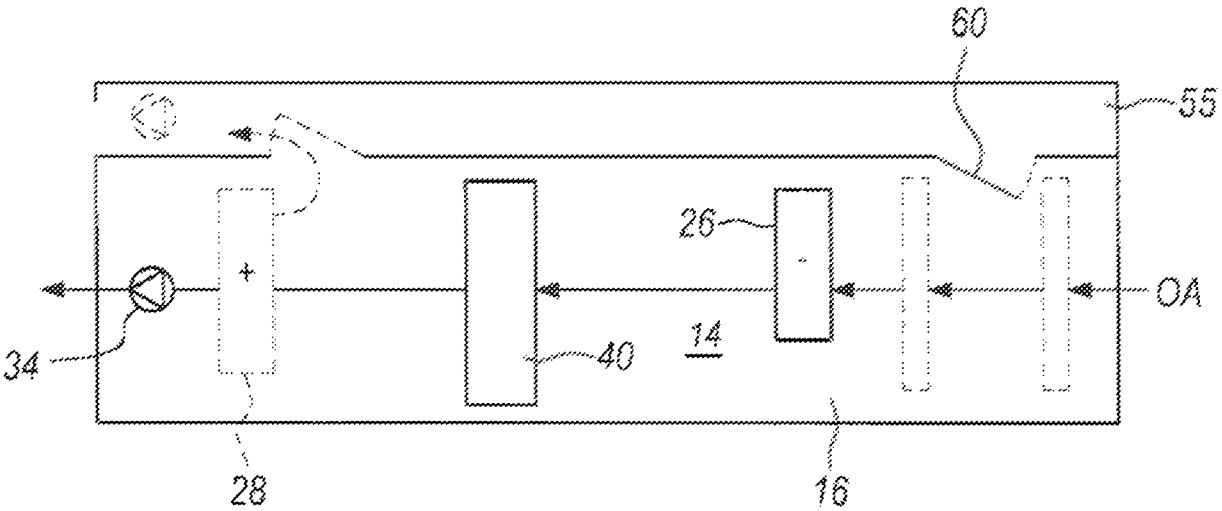
FIG. 4B is a schematic side view of the plenum 16 shown in FIG. 4, including the bypass plenum.

FIGS. 4, 4A and 4B illustrate another embodiment of the invention which is adapted to direct a portion of the heated air in plenum 18 leaving condenser 28 into the third plenum 55. This is accomplished by the use of a selectively operable damper 57 which allows some of the heated air from the condenser 28 to enter plenum 55 to heat or replace the ambient air normally in that plenum. The damper 57 would typically be operated when the outside air temperature is at or below the temperature the bypass air is designed to provide. Details of this embodiment follow.

The present invention effectively and efficiently dehumidifies and cools process air to be supplied to a space using the desiccant wheel 38 and the DX system 24. However, under certain ambient conditions, dehumidification may be needed, but not enough to operate the desiccant wheel. When the wheel is not required for dew point control, a wheel bypass damper (unshown) can open to reduce air pressure drop and fan 34 can be operated at a lower speed to save energy. The wheel bypass damper is designed to bypass the airflow in first plenum 16 around the process segment of the desiccant wheel. As a further option, a second wheel bypass damper can be provided to bypass the airflow in second plenum 18 around the regeneration segment of the desiccant wheel. As an example, if the target dewpoint is 45° F. and the ambient air temperature is 49° F., operating the first stage compressor may be sufficient to achieve the desired dewpoint without the use of the desiccant wheel. However, the resulting supply air would be cooled to 45° F., which may be lower than the desired supply air temperature. In that case, the supply air is preferably heated before entering the space. In the present embodiment, this is achieved by using a portion of the air in plenum 18 heated by condenser 28 and bypassing that heated air to the supply airflow, preferably via third air plenum 55. This bypass is achieved by opening damper 57 to the desired degree, so as to control the amount of heated air from the second air plenum 18 to be directed to the third air plenum 55.

Figure 5:
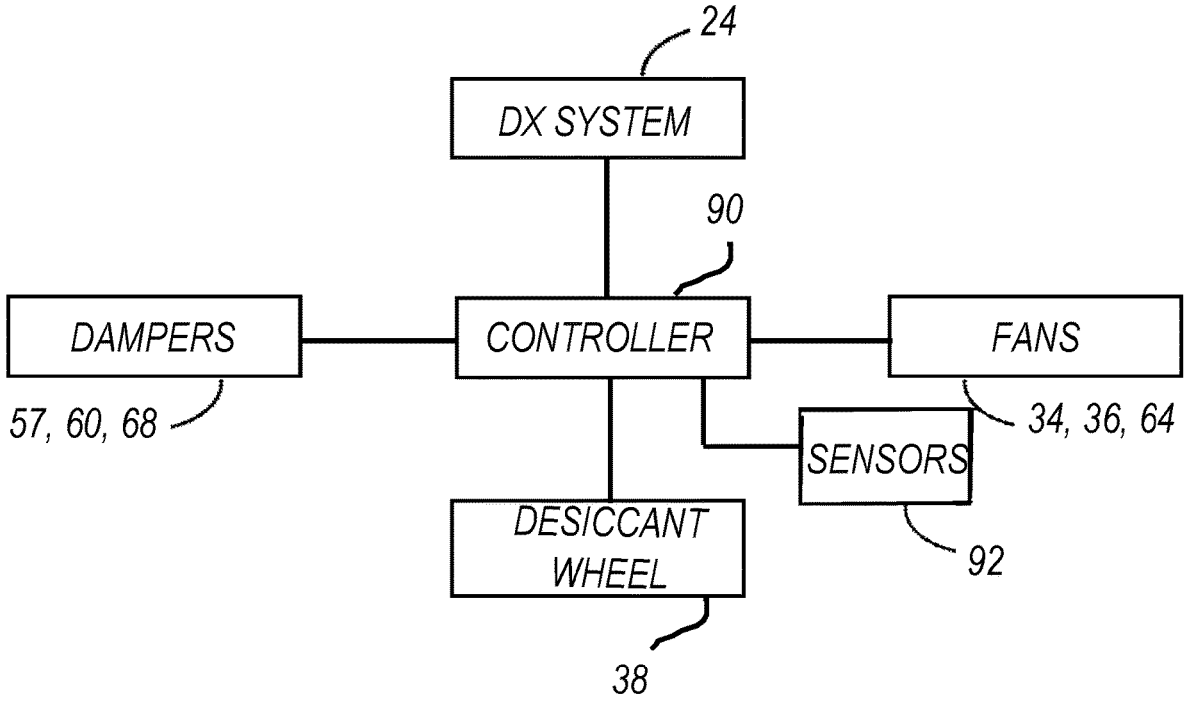
FIG. 5 is a block diagram of control of the system of the present invention.

The embodiments of the present invention can use a system controller as shown in FIG. 5. Preferably, the internal functions of the system are controlled by a controller 90, which is preferably constituted by a microprocessor, but not limited thereto. Controller 90 can be controlled by an external control source that provides run commands. The controller 90 can be associated with various system sensors 92 so as to monitor one or more of internal pressures, temperature and humidity, as well as ambient (outside) temperature and dewpoint and space (inside) temperature and dewpoint. The controller 90 communicates with the DX system 24, the desiccant wheel 38, the various fans 34, 36, 64, and the various dampers 57, 60, 68, so as to reliably control the system functions. The controller can be programmed to stage dehumidification, cooling, and heating as well as damper operation. For example, the controller can control the fans 34, 36 and staged operation of the compressors in the DX system 24 to the desired level of supply airflow, dehumidification, cooling, and regeneration, control a motor that drives the desiccant wheel 38 so that it is stopped or rotates (continuously or intermittently) at a target rotational speed to achieve the desired level of dehumidification, and control motors that operate dampers 57, 60, 68 from a closed state to a target aperture to control the flow of bypass air through the system. In addition to or in lieu of controlling dampers 60, 68, controller 90 can control fan 64 to control the flow of bypass air through the third air plenum 55.

In the embodiments of FIGS. 4-4B, for example, controller 90 receives a run signal to initiate operation of supply fan 34 based on a set point. Depending on whether the space dew point is higher than, lower than, or within the required dew point range, controller 90 controls stages of dehumidification and cooling by controlling stages of compressors of DX system 24, the rotation of desiccant wheel 38, and the rotational speeds of supply and regeneration fans 34, 36. The controller 90 further modulates the temperature and humidity of the supply air by modulating the flow of bypass air through the third air plenum 55 by controlling dampers 60, 68 and/or fan 64. As noted above, under conditions in which the DX system can achieve the set dew point at its first stage without the need for desiccant wheel 38, the controller 90 controls to shut down the desiccant wheel, open the bypass in the first plenum 16 around the desiccant wheel, and set the DX system at the first stage. If the dehumidified supply air is at a temperature lower than the target temperature, controller 90 controls to open damper 57 to direct air in air plenum 18, after being heated by condenser coil 28, to the third air plenum so as to increase the temperature of the supply air. As a modification, fan 64 is not provided and dampers 60, 68 are stationary, at least during operation. In such a case, the flow of air through the third air plenum is completely dependent on the speed of fan 34, and, if damper 57 is open, the speed of fan 36. Those fans, the DX system, and the desiccant wheel are adjusted to modulate the temperature and moisture content of the supply air. No adjustments are made in the third air plenum.

Although illustrative embodiments of the present invention have been described herein with reference to the accompanying drawings, it is to be understood that the invention is not limited to those precise embodiments, but that various changes and modifications can be made thereto by those skilled in the art without departing from the scope or spirit of this invention.

What is claimed is:

1. An air conditioning and dehumidification system comprising:

an enclosed housing having a dividing wall dividing the housing into first and second air plenums;

a refrigeration circuit including an evaporator coil in the first plenum and a condenser coil in the second plenum;

a dehumidification system in the housing including a desiccant wheel rotatably mounted in the housing to rotate in a plane perpendicular to the dividing wall whereby one segment of the wheel functioning as a process segment is located in the first plenum and a second segment of the wheel functioning as a regeneration segment is located in the second plenum;

an ambient air supply air fan for drawing ambient air into the first plenum through the evaporator coil and then selectively through the process segment of the desiccant wheel whereby the ambient air in the first plenum is cooled and dehumidified and supplied from the first plenum to a space;

an ambient air regeneration fan for drawing ambient air into the second plenum, through the condenser, and then selectively through the regeneration segment of the desiccant wheel and discharging the air downstream of the desiccant wheel to the outside of the housing;

an ambient air bypass defining a third plenum so as to supply ambient air through the third plenum and to the space as an ambient bypass airstream; and a heated air passage defining a passage from the second plenum to the ambient air bypass to allow heated air from the second plenum to be directed to the ambient air bypass as a heated bypass airstream.

2. The system as defined in claim 1, further comprising a system controller, wherein the system controller controls at least one of the refrigeration circuit, the desiccant wheel, the ambient air supply fan, the ambient air regeneration fan, the ambient air bypass, and the heated air passage.

3. The system as defined in claim 2, wherein the system controller controls the heated air passage to control the flow of heated air from the second plenum to the ambient air bypass to modify the temperature of the air exiting the ambient air bypass.

4. The system as defined in claim 3, further comprising a damper in the heated air passage, wherein the system controller controls the damper to control the flow of heated air from the second plenum to the ambient air bypass.

5. The system as defined in claim 2, wherein the system controller controls the desiccant wheel and the heated air passage based on set temperature and humidity.

6. The system as defined in claim 2, wherein under predetermined conditions, the system controller controls the refrigeration circuit to operate and process the air in the first plenum without the use of the dehumidification system and controls to selectively heat the ambient bypass airstream.

7. The system as defined in claim 1, wherein the ambient bypass airstream is selectively heated and cooled.

8. The system as defined in claim 7, wherein the ambient bypass airstream is selectively heated by airflow from the heated air passage and selectively cooled with at least one of a chilled water coil and a second evaporator coil in the ambient air bypass.

9. The system as defined in claim 1, wherein the ambient bypass airstream is selectively supplied through the third plenum using at least one of an ambient air bypass fan and at least one ambient air bypass damper.

10. A method for conditioning ambient air for supply to a space, the method comprising the steps of:

cooling, in a first passage, a first ambient supply airstream with a cooling coil of a refrigerant system, then selectively passing the cooled ambient supply airstream through a segment of a rotating desiccant wheel to further reduce the moisture content of the first ambient airstream, and passing the thus treated air to the space;

heating, in a second passage, a second ambient airstream with a condensing coil of the refrigerant system and selectively passing the heated second ambient airstream through a regeneration segment of the desiccant wheel to regenerate the desiccant wheel;

bypassing a portion of the first ambient supply airstream around the cooling coil in the first passage and into the space as an ambient bypass airstream; and selectively heating the ambient bypass airstream before reaching the space.

11. The method as defined in claim 10, wherein the ambient bypass airstream is heated with a heated bypass airstream from the second passage upstream of the desiccant wheel.

12. The method as defined in claim 10, further comprising the step of selectively cooling the ambient bypass airstream.

13. The method as defined in claim 12, wherein the step of selectively cooling the ambient bypass airstream includes using a second evaporator coil or chilled water in the ambient bypass airstream.

14. An air conditioning and dehumidification system comprising:

a first passage through which a first ambient supply airstream flows and exits as supply air to a space;

a second passage through which a second ambient supply airstream flows;

a refrigeration circuit including an evaporator coil in the first passage and a condenser coil in the second passage;

a desiccant wheel rotating in a plane perpendicular to the first and second passages, the desiccant wheel being divided into plural segments including a first segment functioning as a process segment and located in the first passage and a second segment functioning as a regeneration segment and located in the second passage; and an ambient air bypass defining a third passage through which bypass ambient air passes, the bypass ambient air bypassing the evaporator coil and the first segment of the desiccant wheel before entering the space, wherein the bypass ambient air is selectively heated in the third passage before entering the space as a bypass airstream.

15. The system as defined in claim 14, further comprising a heated air passage defining a fourth passage from the second passage to the ambient air bypass to allow heated air from the second passage to be directed to the ambient air bypass as a heated bypass airstream.

16. The system as defined in claim 15, wherein the bypass airstream is selectively heated by the heated bypass airstream from the heated air passage and selectively cooled with at least one of a chilled water coil and a second evaporator coil in the ambient air bypass.

17. The system as defined in claim 14, further comprising a system controller, wherein the system controller controls at least one of the desiccant wheel and the selective heating of the bypass ambient air in the third passage based on set temperature and humidity.

18. The system as defined in claim 14, further comprising a system controller, wherein the system controller controls at least one of the refrigeration circuit, the desiccant wheel, flow of the first ambient supply airstream, flow of the second ambient supply airstream, flow of the bypass airstream through the third passage, and the selective heating of the bypass ambient air in the third passage.

* * * * *